United States Patent [19]

Frazzell

[11] Patent Number: 4,718,837

[45] Date of Patent: Jan. 12, 1988

[54] MARINE DRIVE WATER PUMP IMPELLER

[76] Inventor: Michael E. Frazzell, 756 Kensington Rd., Neenah, Wis. 54956

[21] Appl. No.: 897,628

[22] Filed: Aug. 18, 1986

[51] Int. Cl.[4] ..... F04C 5/00; B28B 7/20; B29C 65/00

[52] U.S. Cl. ..... 418/154; 156/245; 264/255; 264/257; 264/273

[58] Field of Search ..... 418/154, 155; 156/173, 156/245; 264/137, 249, 255, 257, 273, 275, 557

[56] References Cited

U.S. PATENT DOCUMENTS

| | | | |
|---|---|---|---|
| 2,466,440 | 4/1949 | Kiekhaefer | 418/154 |
| 3,673,025 | 6/1972 | Fukuyama et al. | 156/245 |
| 3,733,233 | 5/1973 | Griffiths | 156/173 |
| 4,392,779 | 7/1983 | Bloemers et al. | 418/154 |
| 4,483,214 | 11/1984 | Mayer | 156/245 |

OTHER PUBLICATIONS

J. F. Kober, "Filament Winding", Modern Plastics Encyclopedia 1985–1986, p. 315.

SPI Handbook of Technology and Engineering of Reinforced Plastics/Composites, Chapter V–I, "Filament Winding", Mohr, Oleeski, Shook, and Meyer, second edition, 1973, Van Nostrand Reinholt Company, New York, pp. 243–267.

Polygon Products Brochure, Polygon Company, Industrial Park, P.O. Box 176, Walkerton, Ind. 46574–0176, 1984.

*Primary Examiner*—John J. Vrablik

*Attorney, Agent, or Firm*—Andrus, Sceales, Starke & Sawall

[57] ABSTRACT

A marine drive water pump impeller (1) is provided for a marine rotary vane positive displacement water pump. A filament wound annular drive hub (3) is cured with resin polymer. A rubber annular base (6) having a plurality of flexible radial vanes (7), is molded in place around the drive hub (3). The resin polymer and the rubber are compatible and enable substantial bond strength therebetween. The hub (3) is wound in the circumferential hoop direction, providing substantial hub strength. The invention overcomes frozen water pump problems in marine drives used in freezing environments.

5 Claims, 2 Drawing Figures

MARINE DRIVE WATER PUMP IMPELLER

BACKGROUND AND SUMMARY

The invention relates to marine drive water pumps, and particularly addresses problems with frozen water pumps.

In a marine drive when the unit is frozen in water, or water otherwise freezes in the pump, the pump impeller fails when the starter rope is pulled or the engine cranked because the impeller and its mounting and/or bonding arrangement is not strong enough to crush the ice.

A marine drive water pump is typically a rotary vane positive displacement pump having a pump driveshaft, a drive hub around the driveshaft and keyed thereto to rotate therewith, and a plurality of flexible vanes extending radially outwardly and bonded to the hub along an annular vane base portion, for example as shown in Kiekhaefer U.S. Pat. No. 2,466,440 and Bloemers et al U.S. Pat. No. 4,392,779. Various metals have been used for the drive hub, including brass and stainless steel. Plastic hubs have also been used, for example injection molded nylon, and which may also be reinforced, such as with glass or other random chopped fibers.

Metal hubs are susceptible to rubber adhesion failures due to galvanic action at the bond interface with the vanes. Non-metallic plastic hubs solve the adhesion problem, and are strong enough for normal duty. However, plastic hubs crack and split if abused or subjected to higher torsional loading, which occurs when the pump assembly freezes full of ice.

The present invention addresses and solves the above noted problems. The invention solves the problem of hub splitting due to torsional loading, while still retaining rubber bond adhesion to the hub. The invention thus provides both of the above noted previously incompatible results. The invention applies filament winding technology to a marine drive water pump impeller, which application has been found to afford significant performance improvements. The invention enables exceptional strength in the desired direction, namely circumferential hoop strength, without sacrificing bond adhesion strength.

DETAILED DESCRIPTION

Figure 1:
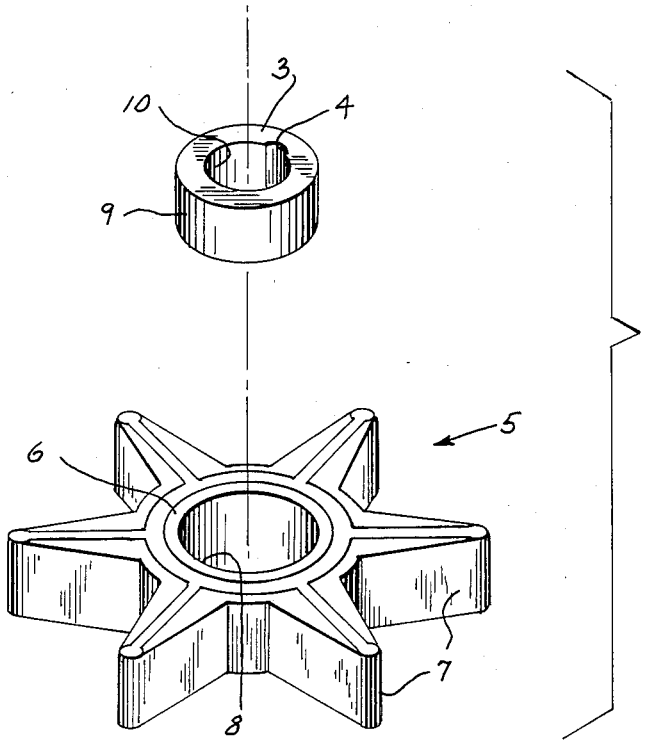
FIG. 1 is an exploded perspective view of a marine drive water pump impeller constructed in accordance with the invention.
Figure 2:
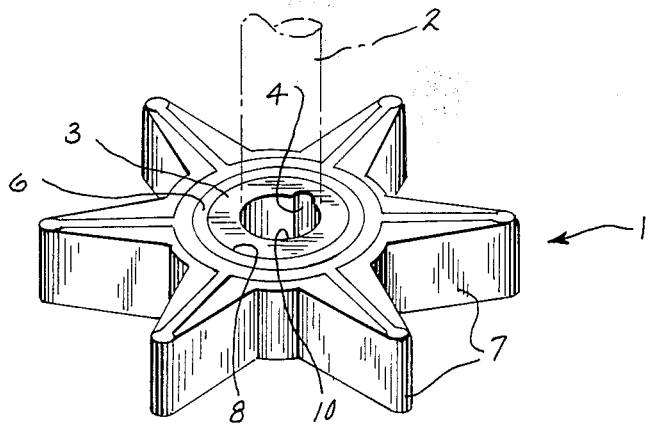
FIG. 2 is an assembly view of the impeller of FIG. 1.

FIG. 2 shows a marine drive water pump impeller 1 for a marine rotary vane positive displacement pump having a pump driveshaft 2, for example as shown in the above noted Kiekhaefer U.S. Pat. No. 2,466,440 and Bloemers U.S. Pat. No. 4,392,779, hereby incorporated herein by reference. An annular drive hub 3, FIG. 1, is disposed around driveshaft 2 and keyed thereto with a key-way notch 4 to rotate therewith, for example as shown in the Bloemers et al patent. Vane means 5, FIG. 1, is provided by an annular base 6 bonded to hub 3 and having a plurality of flexible vanes 7 extending radially outwardly therefrom. Rotary positive displacement pumping action is shown in FIG. 1 of the Kiekhaefer patent and in FIG. 5 of the Bloemers et al patent. As noted in Bloemers et al, vane means 5 is formed of a flexible rubber material, for example nitrile elastomer.

In the present invention, drive hub 3 is a filament wound member, preferably wound in the circumferential hoop direction and cured with a resin polymer, for which further reference may be had to: "Filament Winding", J. F. Kober, Modern Plastics Encyclopedia 1985–1986, p.315; SPI Handbook of Technology and Engineering of Reinforced Plastics/Composites, Chapter V-I, "Filament Winding", Mohr, Oleeski, Shook, and Meyer, Second Edition, 1973, Van Nostrand Reinholdt Company, New York, pgs. 243–267; and Polygon Products Brochure, Polygon Company, Industrial Park, P.O. Box 176, Walkerton, Indiana 46574-0176. It is preferred that hub 3 be a single continuous filament wound member. A circumferential hoop weave is an alternative. After winding and curing, key-way notch 4 is cut into the inner circumferential surface 10 of hub 3, for keying to driveshaft 2, for example as shown in the Bloemers et al patent. Alternatively, notch 4 may be molded in place. In the disclosed embodiment, epoxy is the resin polymer. Alternatives include polyester and polyimide. The filament fiber is glass. Alternatives include Kevlar-aramid, carbon and boron.

The inner circumference 8 of the rubber vane annular base portion 6 is molded in place over the outer circumference 9 of annular drive hub 3. The rubber adheres and bonds to the resin polymer at surface 9, to thus enable substantial bond strength between hub 3 and vane base 6. This bond strength is substantially greater than with a metal hub. A metal hub is less compatible to such bonding, is subject to galvanic corrosion, and can surface oxidize prior to bonding.

With respect to strength of the hub itself, fracture tests were conducted on a prior glass reinforced nylon hub versus the present continuous filament wound hub. The hubs were subjected to an expansion test wherein a steel cone is forced into the hub. The nylon hub completely fractured at a load of 200–300 pounds. The filament wound hub suffered only a partial fiber fracture at 1,850–2,000 pounds of load.

The resin polymer of hub 3 and the rubber of annular vane base 6 thus enable substantially increased bond strength therebetween, as compared with a metal hub, and without sacrificing the strength of the hub itself. Hub strength is substantially increased as compared with a glass filled nylon hub. The invention thus accomplishes both of the previously incompatible but desirable results of high bond strength and high hub strength. This is particularly beneficial when the marine drive unit is used in freezing environments.

It is recognized that various alternatives and modifications are possible within the scope of the appended claims.

I claim:

1. A marine drive water pump impeller for a marine rotary vane positive displacement water pump having a pump driveshaft, comprising a filament wound annular drive hub around said driveshaft and keyed thereto to rotate therewith, and vane means comprising an annular base bonded to said hub and having a plurality of flexible vanes extending radially outwardly therefrom, such that said filament wound annular drive hub has sufficient circumferential hoop strength, without sacrificing the strength of bond adhesion to said annular base of said vanes, to crush ice in said pump in a freezing environment.

2. The invention according to claim 1 wherein said hub comprises a resin polymer, and wherein said annular base of said vane means comprises rubber, to enable substantial bond strength between said hub and said base.

3. The invention according to claim 2 wherein said hub is wound in the circumferential hoop direction, to provide substantial hub strength.

4. The invention according to claim 3 wherein said hub is wound by a single continuous filament.

5. The invention according to claim 3 wherein said hub is wound by a circumferential weave.

* * * * *

UNITED STATES PATENT AND TRADEMARK OFFICE

CERTIFICATE OF CORRECTION

PATENT NO. : 4,718,837

DATED : January 12, 1988

INVENTOR(S) : Michael E. Frazzell

It is certified that error appears in the above-identified patent and that said Letters Patent is hereby corrected as shown below:

ON THE FRONT OF THE PATENT

Insert -- Assignee: BRUNSWICK CORPORATION, Skokie, Illinois--

Signed and Sealed this

Seventh Day of March, 1989

*Attest:*

DONALD J. QUIGG

*Attesting Officer*

*Commissioner of Patents and Trademarks*